US008776709B2

(12) United States Patent
Gonzalez et al.

(10) Patent No.: US 8,776,709 B2
(45) Date of Patent: Jul. 15, 2014

(54) APPARATUS AND METHOD FOR WATERCRAFT STABILIZATION

(75) Inventors: Mario Gonzalez, Glendale, AZ (US); Bradley Arkwright, Phoenix, AZ (US); Joshua Tyndall, Peoria, AZ (US)

(73) Assignee: Honeywell International Inc., Morristown, NJ (US)

( * ) Notice: Subject to any disclaimer, the term of this patent is extended or adjusted under 35 U.S.C. 154(b) by 131 days.

(21) Appl. No.: 13/531,074

(22) Filed: Jun. 22, 2012

(65) Prior Publication Data

US 2013/0340663 A1 Dec. 26, 2013

(51) Int. Cl.
*B63B 9/08* (2006.01)

(52) U.S. Cl.
USPC ..... 114/121; 114/122; 114/24

(58) Field of Classification Search
USPC ..... 414/803, 139.9, 138.3; 705/28; 114/121, 122, 24
See application file for complete search history.

(56) References Cited

U.S. PATENT DOCUMENTS

| | | | | |
|---|---|---|---|---|
| 4,854,800 | A * | 8/1989 | Frick et al. | 414/138.2 |
| 5,154,561 | A * | 10/1992 | Lee | 414/138.3 |
| 5,839,386 | A | 11/1998 | Frieling et al. | |
| 6,050,767 | A * | 4/2000 | Gay et al. | 414/139.9 |
| 6,360,838 | B1 | 3/2002 | Kulhavy | |
| 6,619,221 | B2 | 9/2003 | Umemura et al. | |
| 6,964,552 | B1 * | 11/2005 | Krabbendam | 414/803 |
| 6,973,847 | B2 | 12/2005 | Adams et al. | |
| 7,240,630 | B2 | 7/2007 | Akers | |
| 7,458,329 | B2 | 12/2008 | Nedwed | |
| 2003/0029367 | A1 | 2/2003 | Umemura et al. | |
| 2008/0120201 | A1 * | 5/2008 | Velazquez et al. | 705/28 |
| 2008/0167768 | A1 | 7/2008 | Rubenstein et al. | |
| 2008/0271550 | A1 | 11/2008 | Muessli | |
| 2008/0303363 | A1 | 12/2008 | Alston | |
| 2009/0200428 | A1 | 8/2009 | Smith et al. | |
| 2010/0000349 | A1 | 1/2010 | Stevens et al. | |
| 2011/0030604 | A1 | 2/2011 | Takeuchi et al. | |

* cited by examiner

*Primary Examiner* — Lars A Olson
*Assistant Examiner* — Jovon Hayes
(74) *Attorney, Agent, or Firm* — Ingrassia Fisher & Lorenz, P.C.

(57) ABSTRACT

A transportable watercraft stabilization apparatus includes a stability device configured to impart a stabilizing torque to a watercraft when mounted on the watercraft and a transportable containment device containing the stability device therein. The transportable containment device includes a first attachment apparatus for releasably attaching to a transporting means and a second attachment apparatus for releasably attaching to a coupling device onboard a watercraft. Furthermore, the transportable watercraft stabilization apparatus includes a power source configured to provide power to the stability device for generating the stabilizing torque. The watercraft stabilization apparatus is transportable between a first watercraft and a second watercraft for providing on-demand stabilization to the second watercraft.

20 Claims, 7 Drawing Sheets

APPARATUS AND METHOD FOR WATERCRAFT STABILIZATION

TECHNICAL FIELD

The present disclosure relates generally to watercraft stabilization, and more particularly, the present disclosure relates to rotational devices, such as control moment gyroscopes (CMGs), removably deployed on watercraft to provide stabilization thereto.

BACKGROUND

Numerous operations in open water require the transferring of equipment or the maintaining of a precise orientation between two or more seafaring vessels, between a stationary floating platform and one or more seafaring vessels, or any combination thereof. One common scenario is that of a floating platform or ship transferring equipment from another or several ships in very close proximity. In order to safely transfer equipment therebetween, it is desirable to have the vessels in a stabilized configuration with respect to one another. However, various sea states can cause one vessel to move relative to the other, making the transfer of equipment at best difficult, and at worst dangerous to the crew performing the equipment transfer.

While several apparatus, built into watercraft for the purposes of stabilization, are known in the art, it is appreciated that the majority of the time that the watercraft spends at sea will be without the need for stabilization. More specifically, most of the time a watercraft spends at sea is not transferring equipment from one vessel to another. As such, it is not economical to equip every vessel with advanced stabilization technology when it would only need stabilization while the vessel is maneuvering near another ship.

It would therefore be desirable to provide an apparatus and method for stabilizing watercraft on an "as needed" basis, without the requirement of equipping the watercraft with a dedicated stabilization system. Other desirable features and characteristics of the present disclosure will become apparent from the subsequent detailed description and the appended claims, taken in conjunction with the accompanying drawings and this background of the disclosure.

BRIEF SUMMARY

Apparatus and methods for watercraft stabilization are disclosed herein. In one embodiment, a transportable watercraft stabilization apparatus includes a stability device configured to impart a stabilizing torque to a watercraft when mounted on the watercraft and a transportable containment device containing the stability device therein. The transportable containment device includes a first attachment apparatus for releasably attaching to a transporting means and a second attachment apparatus for releasably attaching to a coupling device onboard a watercraft. Furthermore, the transportable watercraft stabilization apparatus includes a power source configured to provide power to the stability device for generating the stabilizing torque. The watercraft stabilization apparatus is transportable between a first watercraft and a second watercraft for providing on-demand stabilization to the second watercraft.

In another embodiment, a method for stabilizing a watercraft includes transporting a watercraft stabilization apparatus from a first watercraft to a second watercraft, the watercraft stabilization apparatus comprising a stabilizing device contained within a transportable containment device, releasably mounting the watercraft stabilization apparatus on the second watercraft, and activating the stabilizing device of the watercraft stabilization apparatus to provide a stabilizing torque to the second watercraft.

BRIEF DESCRIPTION OF THE DRAWINGS

At least one example of the present invention will hereinafter be described in conjunction with the following figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Any embodiment described herein as "exemplary" is not necessarily to be construed as preferred or advantageous over other embodiments. Furthermore, there is no intention to be bound by any theory presented in the preceding background or the following detailed description.

Figure 1:
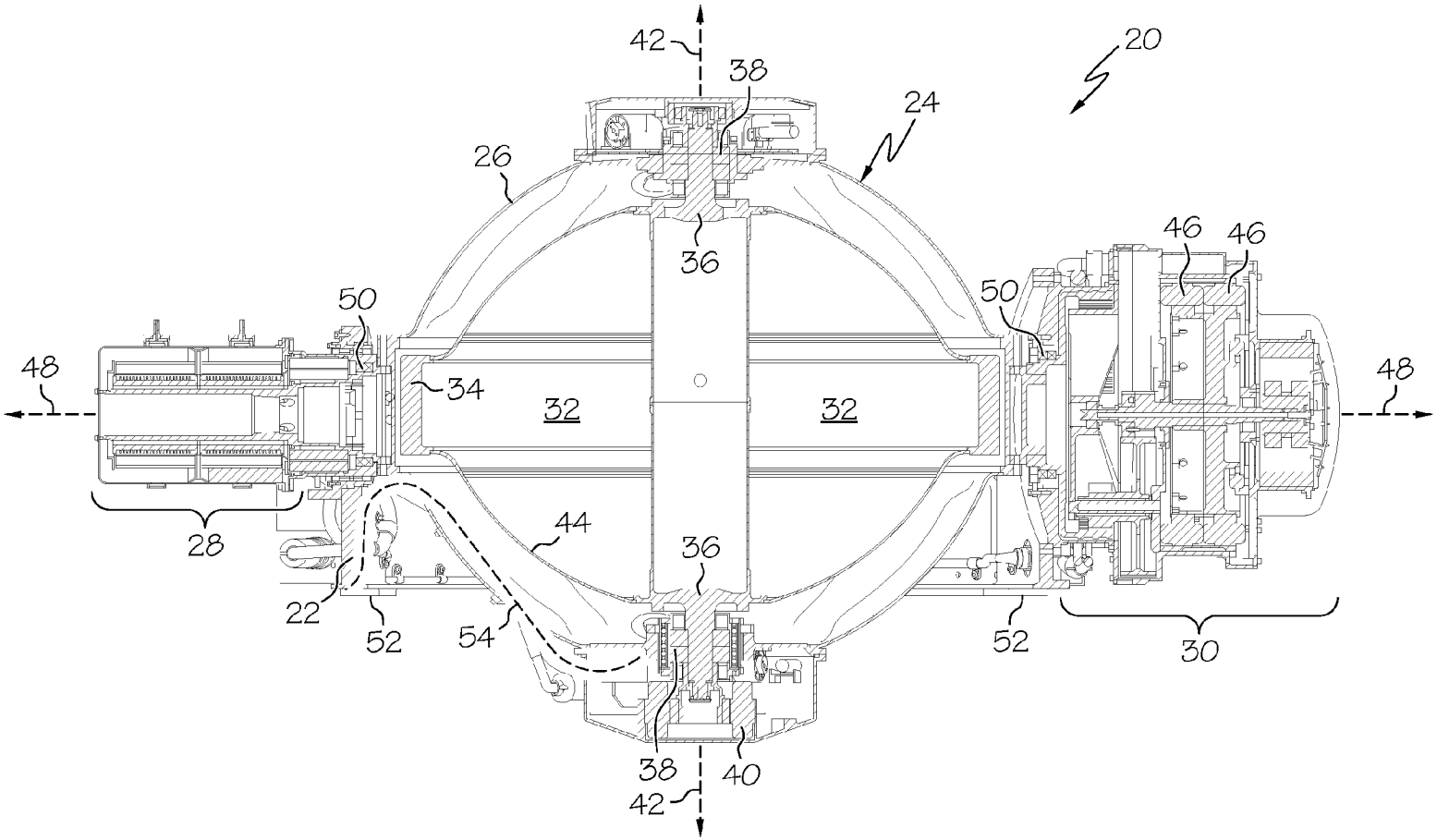
FIG. 1 (PRIOR ART)
FIG. 1 depicts an exemplary stabilizing device of a watercraft stabilization apparatus in accordance with the present disclosure.

An exemplary watercraft stabilization apparatus, in one aspect, includes one or more stabilizing devices. In a preferred implementation, the stabilizing device is embodied as one or more control moment gyroscopes (CMGs). FIG. 1 is a cross-sectional view of a conventional control moment gyroscope (CMG) 20 suitable for use with the presently described apparatus. It is noted, however, that the present disclosure is not limited to the use of any particular CMG. Rather, CMGs of various sizes, shapes, and functionalities are known in the art, and it is expected that a person having ordinary skill in the art will be familiar with and will be able to select a CMG for use in the apparatus and methods described herein.

With continued reference to FIG. 1, CMG 20 includes a CMG housing 22 in which an inner gimbal assembly (IGA) 24 is rotatably mounted. A sensor module assembly (SMA) 28 and a torque module assembly (TMA) 30 are mounted to opposite end portions of CMG housing 22 such that IGA 24 is disposed between SMA 28 and TMA 30. IGA 24 includes a rotor assembly, which, in turn, includes a rotor 32. Rotor 32 comprises an inertial element 34 (e.g., a rotating ring or cylinder) coupled to a shaft 36 by way of a rotor shell 44. Shaft 36 has first and second opposing ends, each of which is received in a different annulus provided in IGA housing 26. To facilitate the rotational movement of rotor 32, a spin bearing 38 (e.g., a floating duplex bearing cartridge or a fixed duplex bearing cartridge) is provided within each annulus and disposed around a shaft end. A spin motor 40 is also disposed around a lower end portion of the shaft and, when energized, imparts torque to rotor 32 to rotate rotor 32 about a spin axis 42.

TMA 30 includes at least one electromagnetic motor 46 that may selectively rotate IGA 24 about a gimbal axis 48. In addition to electromagnetic motor 46, TMA 30 may also include other types of components (e.g., a gear train, a position sensor, a rate sensor, etc.) that are standard in the field and not discussed herein in the interests of concision. To facilitate the rotational movement of IGA 24, first and second gimbal bearings 50 are disposed between CMG housing 22 and IGA 24. Bearings 50 may each assume the form of, for example, a duplex bearing cartridge disposed within an outer sleeve that exerts a predetermined clamping force on the bearing cartridge.

During operation of CMG 20, TMA 30 selectively rotates IGA 24 about gimbal axis 48 to adjust the angular momentum of rotor 32 and, thus, impart gyroscopic torque to the host vessel, for example, a watercraft. When this occurs, torque is transmitted from rotor 32 to the host vessel along a path referred to herein as a direct rotor-to-vessel load path. In addition, excessive heat generated at spin bearings 38 is conducted away from spin bearing 38 and to the vessel through the rotor-to-vessel path. In FIG. 1, a portion of a rotor-to-vessel load path 54 is represented by a dotted line. As can be seen, the illustrated portion of rotor-to-vessel transmission path 54 passes from rotor 32, through spin bearings 38, through IGA housing 26, through gimbal bearings 50, through CMG housing 22, and ultimately to the host vessel. Further details regarding the design and operation of CMG 20, and other exemplary CMGs, can be found, for example, in commonly assigned United States Patent Application Publication 2009/0200428, published on Aug. 13, 2009.

The exemplary watercraft stabilization apparatus, in another aspect, includes a transportable containment device. The transportable containment device is provided for the multiple functions of containing the stabilizing device(s), transporting the stabilizing device(s), and removably mounting the stabilizing device(s) to a host vessel. Each function will be described in greater detail below.

With regard to the containment function of the transportable containment device, the device is configured to fully enclose one or more stabilizing devices. In an embodiment, a transportable containment device encloses one stabilizing device. Within the containment device, a stabilizing device mounting structure is provided to securely mount a stabilizing device within the containment device. In this manner, during operation of the stabilizing device, torque is transmitted from the stabilizing device via the secure mounting with the containment device to the containment device, and subsequently from the containment device to the host vessel as will be described in greater detail below.

Figure 2:
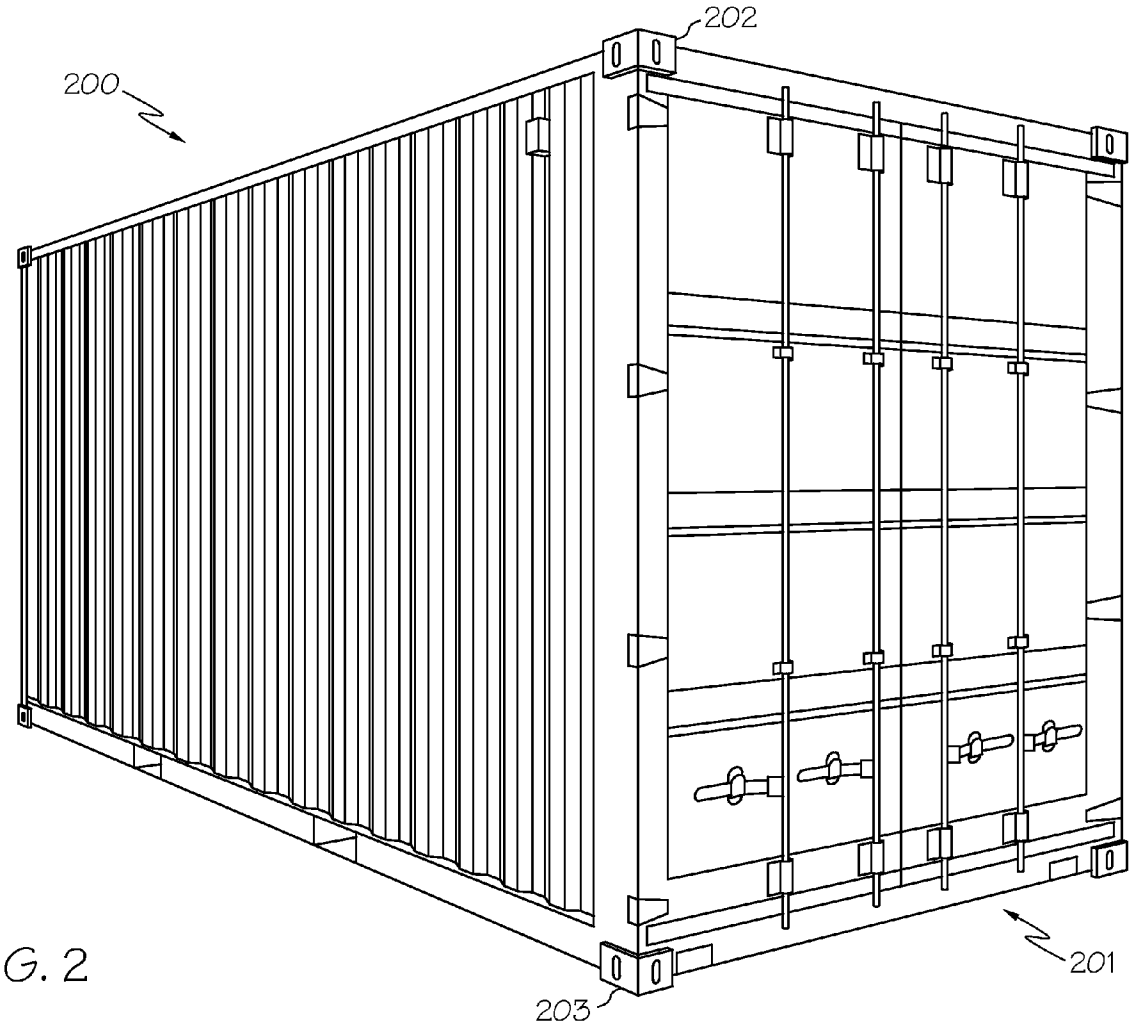
FIG. 2 depicts an exemplary transportable containment device of a watercraft stabilization apparatus in accordance with the present disclosure.

As will be appreciated, adverse weather conditions are often encountered on the open seas, and as such, the transportable containment device is configured to protect the stability device against the elements, such as rain, wind, sea-spray, salt, and other weather conditions that could adversely affect the operation of the stability device. In one example, the containment device is configured in a manner similar to maritime or intermodal shipping containers. As is well-known in the art, such containers typically have doors fitted at one end to allow for the insertion or removal of an object, and are constructed of corrugated weathering steel in a six-sided configuration. An exemplary transportable containment device 200 configured in the manner of a shipping container is depicted in FIG. 2, with the end having door 201 being visible. The sizing of the transportable containment device will vary, and depends primarily on the size of the stabilizing device to be contained therein.

Figure 3:
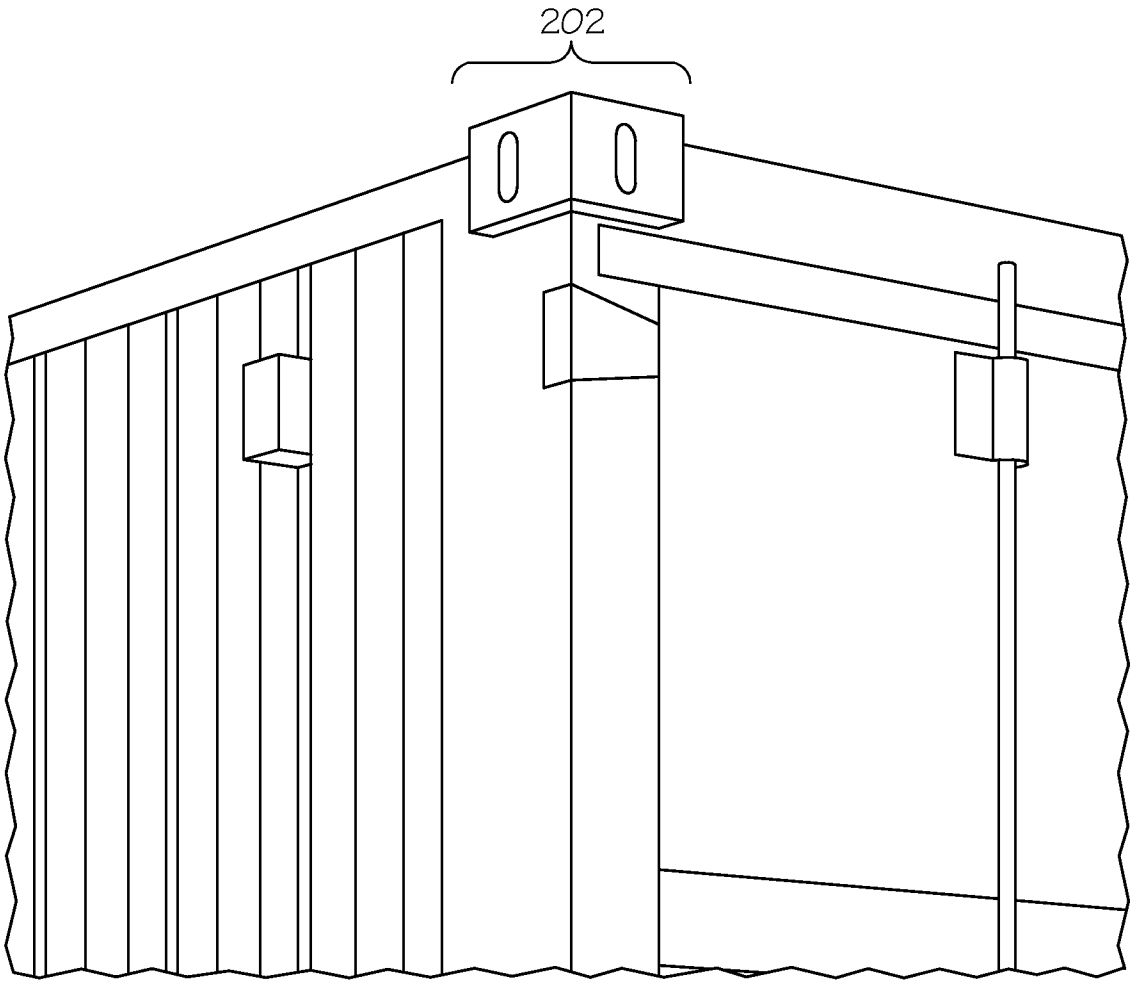
FIG. 3 depicts an expanded view of an exemplary first attachment apparatus of a transportable containment device as shown in FIG. 2.

With regard to the transportation function of the transportable containment device, the device is configured with a first attachment apparatus to allow a transporting means to be attached thereto. Exemplary transporting means include cranes, forklifts, and the like. In operation, the transporting means attaches to the transportable containment device via the first attachment apparatus, preferably positioned on an exterior portion thereof, and transports the transportable containment device from one location to another. With continued reference to the example of a shipping container configuration, the first attachment apparatus can include one or more hooks or mounts at the corners of the upper surface thereof. Using these hooks or mounts, a crane can complete a multi-point attachment thereto (a four-point attachment is common, and provides superior stability during transport) for transporting the container from one position to another. An exemplary first attachment apparatus 202 is depicted on the transportable containment device 200 of FIG. 2, at the corner of an upper surface thereof. FIG. 3 provides an expanded view of the first attachment apparatus 202.

Figure 4:
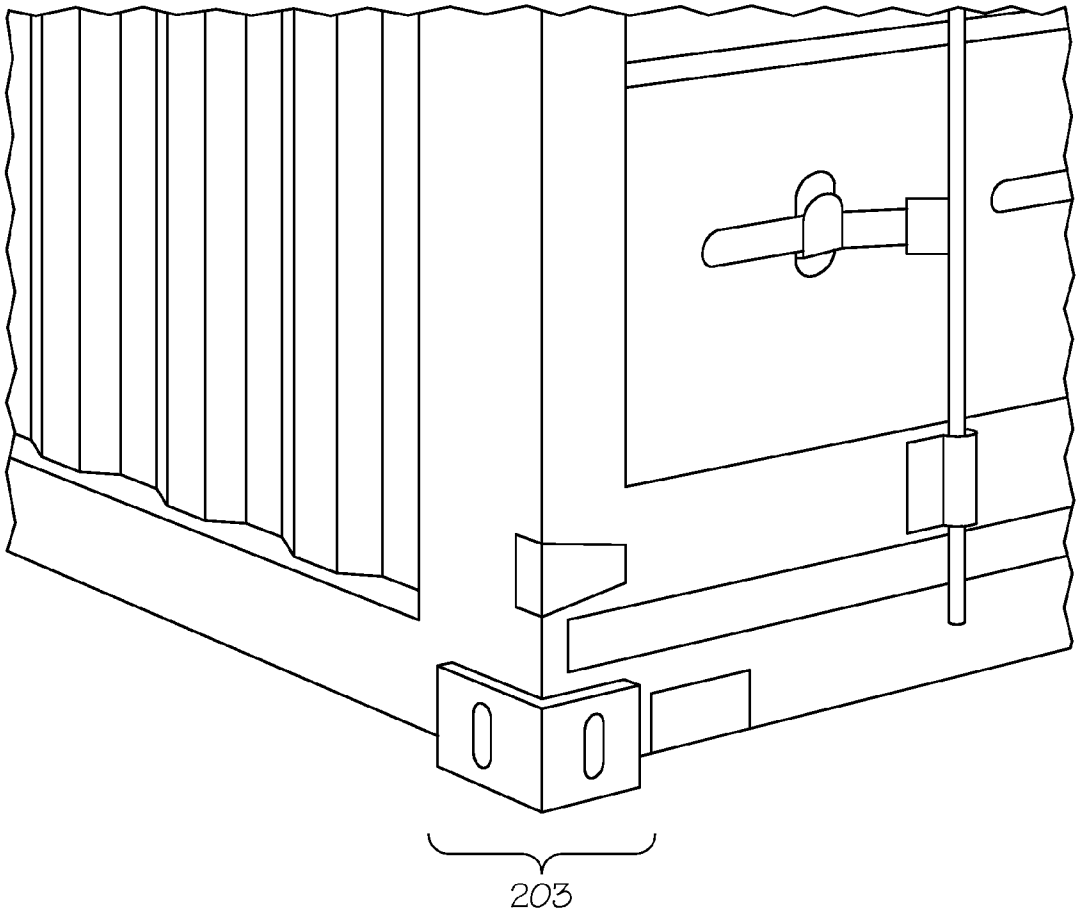
FIG. 4 depicts an expanded view of an exemplary second attachment apparatus of a transportable containment device as shown in FIG. 2.

With regard to the function of removably mounting to a host vessel, the transportable containment device is configured with a second attachment apparatus to allow for removable coupling with a host vessel. As will be appreciated, the host vessel itself will be configured with one or more coupling structures for coupling with the second attachment apparatus of the transportable containment device. The second attachment apparatus is configured so as to allow for fast and simple, yet secure mounting with the host vessel. The second attachment apparatus is further configured so as to allow for fast and simple disengagement with the host vessel. With continued reference to the example of a shipping container configuration, the second attachment apparatus can include one or more mounts at the corners of the lower surface thereof. The transportable containment device is moved into position over the coupling structures on the host vessel, and a secure connection is made between the second attachment apparatus and the coupling structure to securely mount the transportable containment device on the host vessel. To remove the transportable containment device, the second attachment apparatus is disengaged from the coupling structures, and the containment device is moved away. An exemplary second attachment apparatus 203 is depicted on the transportable containment device 200 of FIG. 2, at the corner of lower surface thereof. FIG. 4 provides an expanded view of the second attachment apparatus 202.

The exemplary watercraft stabilization apparatus, in another aspect, includes a stability device power supply component. It will be appreciated that stability devices require energy to operate. As such, the presently disclosed apparatus is configured with a component for supplying power to the stability device while the stability device is contained within the transportable containment device. In one embodiment, the power supply component is provided in an "umbilical cord" configuration. More specifically, power is provided from a central power source, such as the powerplant of a seafaring vessel, and is supplied to the stability device via a long, enclosed power cable that extends from the powerplant to the stability device. The connection between the umbilical cord power supply and the stability control device can be detachable, such that if it is desired to move the stability device from one location to another, such movement is not restricted by a permanent connection via the cord.

In another embodiment, the power supply component is a dedicated power unit, such as a generator or an auxiliary power unit (APU). Generators, APUs, and other similar devices are well-known in the art, and need not be explicated in great detail herein. In operation, the dedicated power unit is associated with the stability device or with the transportable containment device containing the stability device, and is available to supply power thereto on demand.

Figure 5:
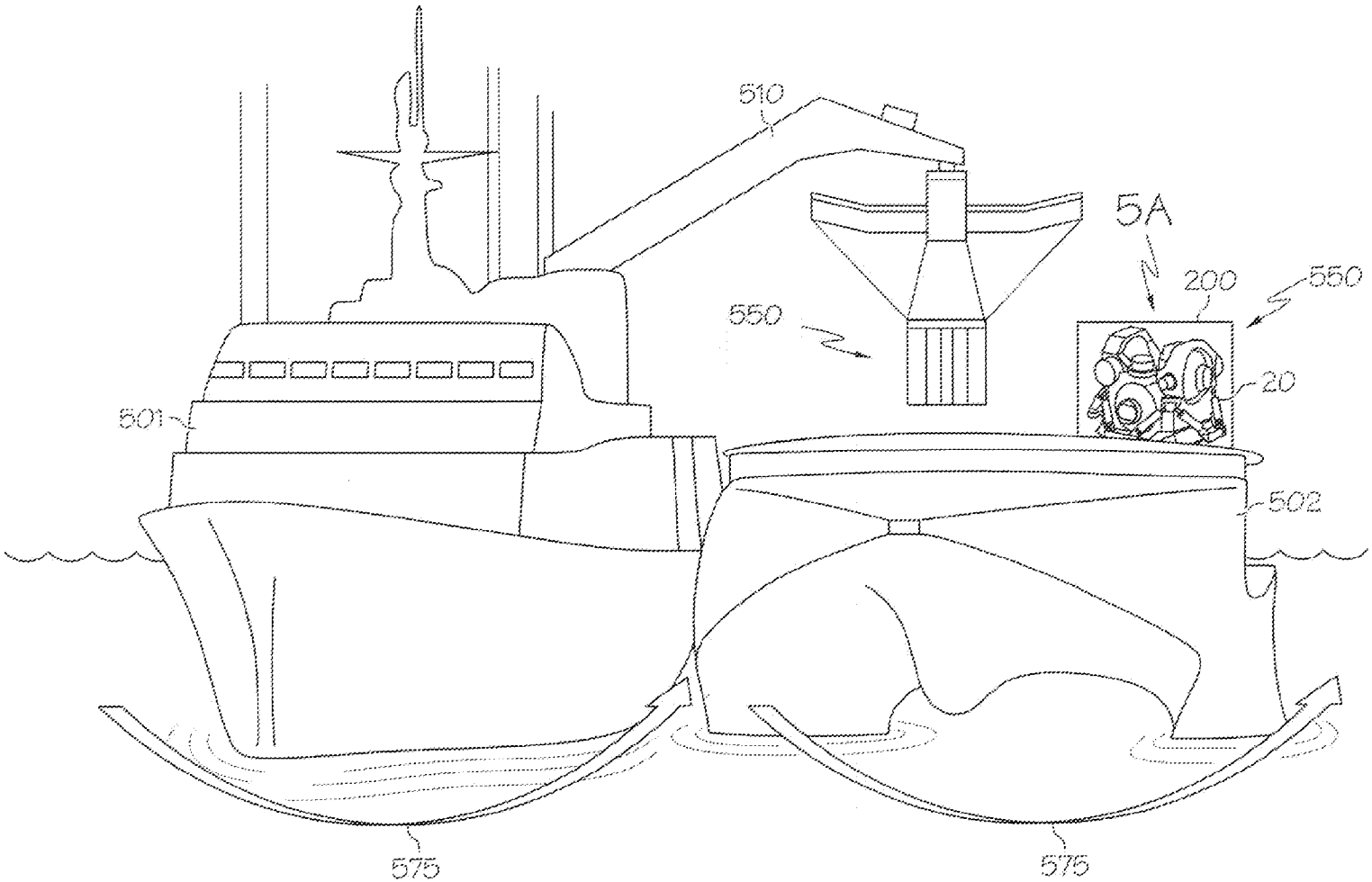
FIGS. 5-6 illustrate an exemplary method of watercraft stabilization using a watercraft stabilization apparatus in accordance with the present disclosure.
Figure 6:
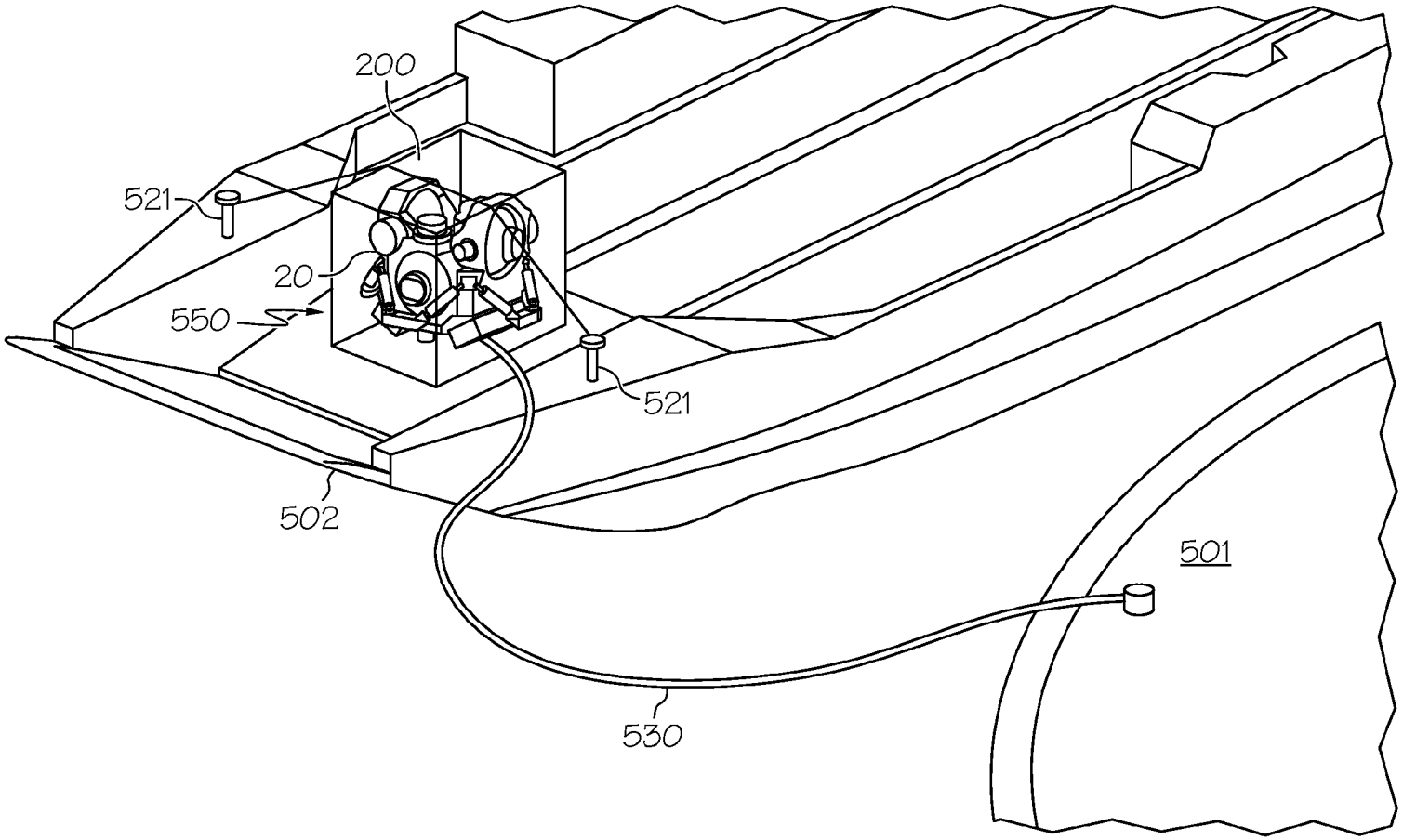

An exemplary method of watercraft stabilization using the presently described watercraft stabilization apparatus is illustrated with reference to FIGS. 5-6. In a first aspect, the exemplary method includes providing one or more watercraft stabilization apparatus. The watercraft stabilization apparatus can be provided and stored on a first watercraft. The first watercraft, in one embodiment, can be a floating platform or other vessel that is semi-permanently situated in one location in open water. One example of a first watercraft is an underwater drilling platform. Another example of a first watercraft is a sea base, such as may be used by the military for conducting offshore operations. Of course, the first watercraft, in practice, could include any other type of watercraft, such as a cargo ship or other vessel.

Figure 5A:
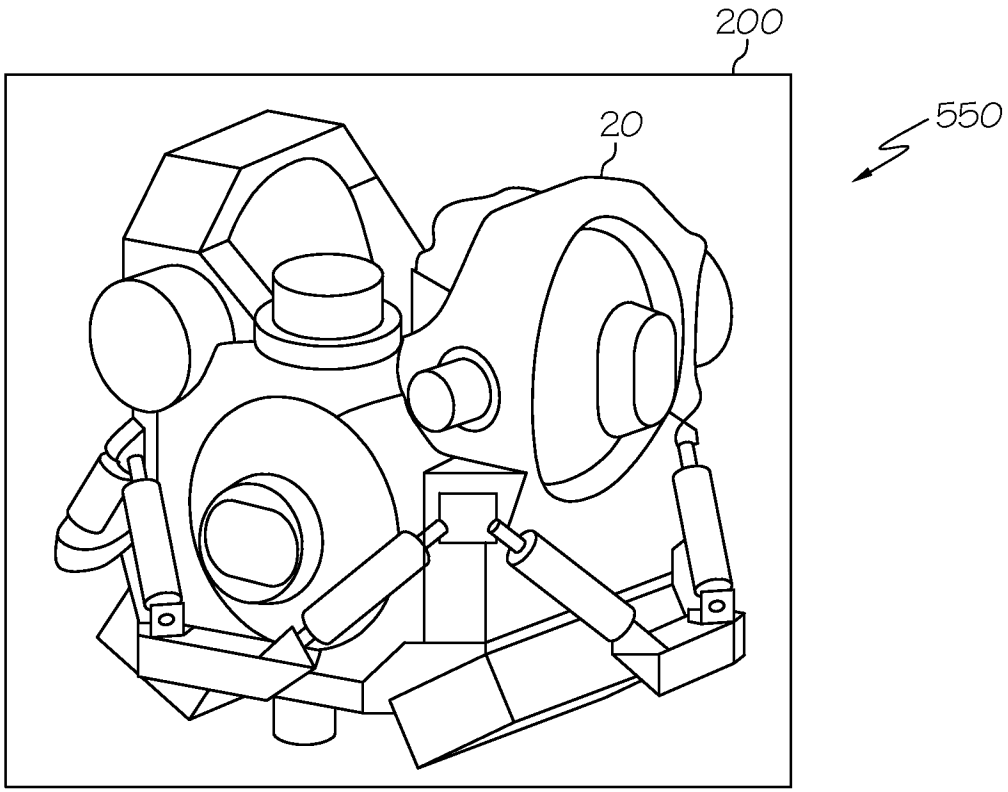

The exemplary method of watercraft stabilization, in another aspect, includes attaching the watercraft stabilization apparatus to a transporting means. As noted above, suitable transporting means include the likes of a crane or a forklift. In the preferred implementation of a crane as the transporting means, connection is made between the crane and the first attachment apparatus located, for example, at the top of the transportable containment device of the watercraft stabilization apparatus. The crane is preferred due to its ability to move objects over open water (in contrast to the likes of a forklift which does not have this ability), which is desirable in operations on open water. With reference to FIG. 5, the step of attaching a watercraft stabilization apparatus to a transporting means is illustrated by way of first watercraft 501, equipped with a crane 510, being attached to a first watercraft stabilization device 550. For purposes of illustration, a second watercraft stabilization device 550 has been illustrated, in cut-away view, after it has been transported from the first watercraft 501 to the second watercraft 502, with greater illustration thereof being provided in FIG. 5A.

The exemplary method of watercraft stabilization, in another aspect, includes transporting the watercraft stabilization apparatus from the first watercraft to a second watercraft. The second watercraft, in one embodiment, can be a vessel such as a cargo ship that is bringing supplies to the first vessel. Using again the example of the first vessel as a drilling platform or a sea base, it will be appreciated that to sustain long-term operations thereon, it is occasionally necessary to re-supply such first vessel with provisions for the crew, operational equipment, and the like. As such, it is often necessary for a second watercraft to position itself alongside the first watercraft. In this position, a crane or similar transporting means can easily transport a watercraft stabilization apparatus from the first watercraft to the second watercraft. Although it is expected that the transporting means for transporting the watercraft stabilization apparatus will be typically employed on the first watercraft, this disclosure should be read to include the possibility that it may be employed on the second watercraft. With continued reference to FIG. 5, a second watercraft 502 is illustrated alongside first watercraft 501. The step of transporting is again illustrated by the watercraft stabilization apparatus being transported by crane 510 between vessels 501 and 502. As previously noted, a cutaway view of a second watercraft stabilization apparatus, showing transportable containment device 200 and stabilizing device 20 therein, is also included on the second watercraft 502 to show an exemplary position of the watercraft stabilization device 550 after it has been transported from the first watercraft 501 to the second watercraft 502.

The exemplary method of watercraft stabilization, in another aspect, includes removably securing the watercraft stabilization apparatus to the second watercraft. As noted above, the transportable containment device of the watercraft stabilization apparatus includes a second attachment means, for example on the lower surface of the transportable containment device, for secure yet removable attachment to a coupling structure of a host vessel, i.e., the second watercraft. As such, once the watercraft stabilizing device has been transported from the first watercraft to the second watercraft, the second attachment apparatus is coupled to the coupling structure, and a secure yet disengageable connection is made. As also noted above, the connection is secure enough to transfer the torque generated by the stabilizing device (located within the transportable containment device) to the host vessel. With reference now to FIG. 6, removable securement is illustrated by the watercraft stabilizing device 550 being mounted onto the second watercraft 502 using a plurality of coupling structures 521.

As an ancillary aspect of the presently described method, it is noted that the transportable containment device may be disengaged from the transporting means. Such disengagement may be performed before, after, or during the securing of the watercraft stabilization apparatus to the second vessel. Alternatively, disengagement need not be performed. Such disengagement is illustrated in FIG. 6.

The exemplary method of watercraft stabilization, in further aspect, includes providing power to the stabilizing device. As noted above, power may be provided by an "umbilical cord." The umbilical cord may be connected to a power-plant on either the first or second vessel, for example. In a preferred implementation, providing power to the stabilizing device includes running an umbilical cord from the first vessel to the second vessel, and connecting the umbilical cord to the stabilizing device. Alternatively, where power is provided by a dedicated APU, generator, or the like, providing power to the stabilizing device may simply include activating the APU, generator, or the like. With continued reference to FIG. 6, providing power to the stabilizing device 20 within transportable containment device 200 is illustrated by umbilical cord 530 running from first watercraft 501 to second watercraft 502. In an exemplary embodiment, because cord 530 runs between watercraft, it is suitably insulated to protect the electrical components thereof against the elements that may be encountered under such conditions, such as rain, salt, and seaspray, among others.

The exemplary method of watercraft stabilization, in yet another aspect, includes activating the stabilizing device to stabilize the second watercraft. Using again the example of a supply ship as the second watercraft bringing supplies to the first watercraft (for example an offshore platform or sea base), an important consideration is making sure that the two watercraft are stabilized while alongside one another to facilitate safe and efficient transfer of supplies. As the supply ship only needs stabilization when alongside another vessel during supplying operations, the vast majority of the time the supply ship will not need stabilization. As such, it is not economical to provide every supply ship with a dedicated stabilization means. Using the method and apparatus disclosed herein, when the stabilizing device has been transported, secured, and activated on the second watercraft, stabilization is provided on an "on-demand" basis, eliminating the need for dedicated stabilization means on each watercraft. With reference back to FIG. 5, activating the stabilizing device 20 of the watercraft stabilization apparatus 550 is illustrated by arrows 575, which are provided to show stabilization of both watercraft 501 and 502 for facilitating transportation of supplies therebetween.

After stabilization is no longer needed on the second watercraft, the stabilizing device can be deactivated, the power source disconnected, the secure attachment between the second vessel and the watercraft stabilization apparatus disengaged, and the apparatus transported back to the first vessel, all in the manner described above with regard to the initial transportation thereof from the first watercraft to the second watercraft.

It is appreciated that different vessels have different stabilization requirements. As such, it is appreciated that a first watercraft may be provided with a plurality of watercraft stabilization apparatus of different sizes and different configurations. Selection of an appropriate watercraft stabilization apparatus for use on a particular second watercraft can thereby be made on a case by case basis, depending on the stabilization requirement of the second vessel (which, as will be appreciated, is primarily a function of the size of the second vessel). In an alternative embodiment, more than one stabilizing device can be transported from the first watercraft to the second watercraft. In order to do so, the procedures noted above are simply repeated for each additional watercraft stabilization apparatus required. Of course, the second vessel will require multiple coupling devices to accommodate the watercraft stabilization apparatus transported thereto. Control techniques are well-known in the art for operating multiple watercraft stabilizing devices on a vessel in an array, and as such need not be repeated herein.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A transportable watercraft stabilization apparatus, comprising:

a stability device configured to impart a stabilizing torque to a first watercraft when mounted on the first watercraft;

a transportable containment device containing the stability device therein, wherein the stability device is fully contained within the transportable containment device, wherein the stability device is mounted to an interior surface of the transportable containment device, and wherein stability device comprises a torque generating device that is capable of generating sufficient torque to effect a stabilization of the first watercraft, and comprising:

a first attachment apparatus for releasably attaching to a transporting means; and a second attachment apparatus for releasably attaching to a coupling device onboard a watercraft; and a power source configured to provide power to the stability device for generating the stabilizing torque, wherein the watercraft stabilization apparatus is transportable between the first watercraft and a second watercraft for providing on-demand stabilization to the first watercraft.

2. The apparatus of claim 1, wherein the stability device is a control moment gyroscope that comprises an inner gimbal assembly (IGA) and a torque module assembly (TMA), wherein the TMA is mechanically coupled with the IGA in a manner that allows the TMA to selectively rotate the IGA about a gimbal axis.

3. The apparatus of claim 1, wherein the transportable containment device is configured to protect the stability device against adverse weather conditions.

4. The apparatus of claim 3, wherein the transportable containment device is configured in the manner of a maritime or intermodal shipping container and comprising six sides of corrugated, weathering steel.

5. The apparatus of claim 1, wherein the first attachment apparatus is configured for releasably attaching to a crane, the first attachment apparatus comprising a multi-point crane cable attachment apparatus positioned along an upper surface of the transportable containment device, and wherein the second attachment apparatus is positioned along a lower surface of the transportable containment device, the lower surface being on an opposite side of the transportable containment device from the upper surface.

6. The apparatus of claim 5, wherein the power source is configured in the manner of an umbilical cord, the power source originating from either the first watercraft or a second watercraft and providing power from either the first watercraft or the second watercraft to the stability device.

7. The apparatus of claim 1, wherein the second watercraft is a sea base or platform and the first watercraft is a supply vessel, and wherein the watercraft stabilization apparatus is releasably mounted on the supply vessel and is operating to provide a stabilizing torque thereto during the transportation of supplies between the sea base or platform and the supply vessel, and wherein the power source extends from the sea base or platform to the watercraft stabilizing apparatus mounted on the supply vessel to provide power from the sea base or platform to the operating watercraft stabilizing apparatus mounted on the supply vessel.

8. A method for stabilizing a watercraft, comprising:

transporting a watercraft stabilization apparatus from a first watercraft to a second watercraft, the watercraft stabilization apparatus comprising a stabilizing device contained within a transportable containment device, and wherein the step of transporting the watercraft stabilization apparatus comprises transporting the watercraft stabilization apparatus in an inactive, unpowered state that does not provide any stabilization functionality during the step of transporting;

releasably mounting the watercraft stabilization apparatus on the second watercraft;

connecting a power supply from either the first watercraft or the second watercraft to the watercraft stabilization apparatus after the steps of transporting and releasably mounting are completed, wherein the step of connecting the power supply comprises transforming the watercraft stabilization apparatus from the unpowered state to a powered state; and activating the stabilizing device of the watercraft stabilization apparatus after the steps of transporting, releasably mounting, and connecting are completed to provide a stabilizing torque to the second watercraft, wherein the step of activating the stabilizing device comprises transforming the watercraft stabilization apparatus from the inactive state to an active state that provides a stabilization functionality.

9. The method of claim 8, further comprising providing a plurality of watercraft stabilization apparatus on the first watercraft.

10. The method of claim 9, further comprising selecting one of the plurality of watercraft stabilization apparatus for transportation to the second watercraft.

11. The method of claim 8, further comprising attaching a transportation means to the transportable containment device using a first attachment apparatus positioned on an upper surface of the transportable containment device.

12. The method of claim 8, wherein releasably mounting the watercraft stabilization apparatus comprises releasably engaging a second attachment apparatus positioned on a lower surface of the transportable containment device to a coupling device onboard the second watercraft.

13. The method of claim 8, wherein the step of connecting the power supply to the stabilizing device comprises running an umbilical cord from the first watercraft to the second watercraft.

14. The method of claim 8, further comprising disengaging the watercraft stabilization apparatus from the second apparatus and transporting the watercraft stabilization apparatus from the second watercraft back to the first watercraft.

15. A method for stabilizing a watercraft, comprising:

receiving a watercraft stabilization apparatus at a first watercraft via transportation from a second watercraft to the first watercraft, the watercraft stabilization apparatus comprising a stabilizing device contained within a transportable containment device, the stabilizing device being of sufficient size to provide a stabilizing effect in unstable seas to the first watercraft, wherein the step of receiving the watercraft stabilization apparatus comprises receiving the watercraft stabilization apparatus in an inactive, unpowered state that does not provide any stabilization functionality during the step of receiving;

releasably mounting the watercraft stabilization apparatus on the first watercraft;

connecting a power supply from either the first watercraft or the second watercraft to the watercraft stabilization apparatus after the steps of receiving and releasably mounting are completed, wherein the step of connecting the power supply comprises transforming the watercraft stabilization apparatus from the unpowered state to a powered state, and wherein the step of connecting the power supply comprising receiving electrical power at the watercraft stabilization apparatus that is releasably mounted on the first watercraft; and activating the stabilizing device of the watercraft stabilization apparatus after the steps of receiving, releasably mounting, and connecting are completed and providing a stabilizing torque to the first watercraft from the watercraft stabilization apparatus that is releasably mounted on the first watercraft, wherein the step of activating the stabilizing device comprises transforming the watercraft stabilization apparatus from the inactive state to an active state that provides a stabilization functionality.

16. The method of claim 15, wherein the step of receiving the watercraft stabilization apparatus comprises receiving the watercraft stabilization apparatus at the first watercraft via transportation using a crane mounted on the second watercraft, the watercraft stabilization apparatus comprising a multi-point crane cable attachment apparatus positioned along an upper surface thereof.

17. The method of claim 16, wherein the step of releasably mounting the watercraft stabilization apparatus comprising mounting the watercraft stabilization apparatus to a deck of the first watercraft using a releasable attachment apparatus positioned along a lower surface of the transportable containment device, the lower surface being on an opposite side of the transportable containment device from the upper surface.

18. The method of claim 15, further comprising repeating the steps of receiving, releasably mounting, connecting, and activating for a second watercraft stabilization apparatus.

19. The method of claim 15, further comprising disengaging the watercraft stabilization apparatus from the first watercraft and transporting the watercraft stabilization apparatus from first water craft back to the second watercraft.

20. The method of claim 19, wherein the step of disengaging the watercraft stabilization apparatus comprises disconnecting the power supply from the watercraft stabilization apparatus and transforming the watercraft stabilization apparatus back to the inactive, unpowered state.

* * * * *